United States Patent [19]

Frosch

[11] Patent Number: 4,693,106

[45] Date of Patent: Sep. 15, 1987

[54] APPARATUS FOR AXIALLY SHIFTING ROLLS IN A ROLL STAND

[75] Inventor: Hans Frosch, Neuss, Fed. Rep. of Germany

[73] Assignee: SMS Schleomann-Siemag Aktiengesellschaft, Dusseldorf, Fed. Rep. of Germany

[21] Appl. No.: 872,101

[22] Filed: Jun. 6, 1986

[30] Foreign Application Priority Data

Jul. 17, 1985 [DE] Fed. Rep. of Germany ..... 3525462

[51] Int. Cl.[4] ..... B21B 31/18

[52] U.S. Cl. ..... 72/247

[58] Field of Search ..... 72/247, 245, 243, 241, 72/237, 20, 21

[56] References Cited

U.S. PATENT DOCUMENTS 4,369,646 1/1983 Kajiwara ..... 72/247

4,499,748 2/1985 Nihei et al. ..... 72/247 X

FOREIGN PATENT DOCUMENTS 0077704 5/1983 Japan ..... 72/247

*Primary Examiner*—Robert L. Spruill

*Assistant Examiner*—Steve Katz

*Attorney, Agent, or Firm*—Karl F. Ross; Herbert Dubno

[57] ABSTRACT

A roll stand having a roll centered on an axis and provided at one end with a journal block is provided with a roll-shifting apparatus which comprises an outer frame fixed relative to the stand at the journal block, a pair of arms extending parallel to one another and having outer ends pivoted on the outer frame at a common arm axis generally perpendicular to the roll axis and inner arms adjacent the block, and actuators engaged between the inner arm ends and the outer frame for vertically displacing the inner arm ends with pivoting of the arms about the arm axis to a position with the inner arm ends generally level with the journal block. An inner frame slides perpendicular to the arm axis on the arms and carries a grab mount pivotal about an inner axis parallel to the arm axis. A grab carried on the mount is axially couplable with the journal block. Another actuator, once again typically a heavy-duty double-acting hydraulic ram, has an inner end pivoted at the arm axis on the outer frame and an outer end pivoted on the inner frame for sliding the frame along the arms and thereby axially displacing the roll coupled to the grab.

7 Claims, 2 Drawing Figures

APPARATUS FOR AXIALLY SHIFTING ROLLS IN A ROLL STAND

FIELD OF THE INVENTION

The present invention relates to an apparatus used to axially shift rolls in a roll stand. More particularly this invention concerns such an apparatus used with rolls that are held in axially shiftable journal blocks.

BACKGROUND OF THE INVENTION

It is known as for example from German Pat. No. 2,440,495 and from U.S. Pat. No. 4,543,810 to provide a six-high roll stand having two outer backup rolls, two inner backup rolls, and two working rolls. Such a roll stand can have a device for displacing the inner backup rolls parallel to their axes, so that the effects of bending of the rolls can be canceled out.

Such an axial-shifting device typically comprises two rigid arms projecting axially from one of the journal blocks of the roll to be shifted, and a massive hydraulic ram having an outer end pivoted about a normally horizontal axis on the stationary machine frame and an inner end pivoted about another horizontal axis on the outer ends of the arms. Such a cylinder can be expanded to move the respective roll in and contracted to move it out. The pivots are provided so that the shifting apparatus can follow any vertical movements of the roll to be shifted.

Even if such a ram is coupled to an axially slidable pusher as described in German patent document No. 3,145,134 there is a considerable radial force vector applied to the machine. Normally this lateral force is applied to the journal block and its arms. Thus whatever structure is provided to stand against this lateral force must be substantial and must also be provided with some troublesome lubrication system, as considerable movement is required.

OBJECTS OF THE INVENTION

It is therefore an object of the present invention to provide an improved apparatus for shifting a roll in a roll stand.

Another object is the provision of such a apparatus for shifting a roll in a roll stand, in particular an inner backup roll of a six-high stand, which overcomes the above-given disadvantages, that is which bears axially against the journal blocks and that incorporates structure that can easily withstand any forces caused by noncoaxial alignment of the main ram and the roll to be moved.

A further object is to provide such a shifting device which can even be used with rolls that are somewhat horizontally offset from the axis of the ram, as for instance in U.S. Pat. No. 4,631,948.

SUMMARY OF THE INVENTION

A roll stand having a roll centered on an axis and provided at one end with a journal block is provided with a roll-shifting apparatus according to the invention which comprises an outer frame fixed relative to the stand at the journal block, a pair of arms extending parallel to one another and having outer ends pivoted on the outer frame at a common arm axis generally perpendicular to the roll axis and inner arms adjacent the block, and actuators engaged between the inner arm ends and the outer frame for vertically displacing the inner arm ends with pivoting of the arms about the arm axis to a position with the inner arm ends generally level with the journal block. An inner frame slides perpendicular to the arm axis on the arms and carries a grab mount pivotal about an inner axis parallel to the arm axis. A grab carried on the mount is axially couplable with the journal block. Another actuator, once again typically a heavy-duty double-acting hydraulic ram, has an inner end pivoted at the arm axis on the outer frame and an outer end pivoted on the inner frame for sliding the frame along the arms and thereby axially displacing the roll coupled to the grab.

This system therefore allows all the transverse forces of the main actuator to bear on the heavy-duty actuators that raise and lower the inner arm ends. The axial force is thereby wholly effective axially on the journal block, making bending of same virtually impossible.

According to another feature of this invention the inner frame has a carriage displaceable on the inner frame parallel to the inner axis and carrying the grab mount. In addition at least one actuator is braced between the inner frame and the carriage for displacing the carriage on the inner frame parallel to the inner axis. Thus the arrangement can also compensate for shifting of the roll from the plane of the other rolls. Furthermore the inner frame has a pair of side members extending along and guided on the respective arms and a crosspiece extending between the members and parallel to the inner axis and the inner actuator end is pivoted on the crosspiece and the carriage is slidable on the crosspiece.

The arms have outer surfaces slidable on inner surfaces of the outer frame so that they are accurately guided therein. Furthermore, an abutment fixed on the outer frame and limiting vertical displacement the arms.

Such an arrangement can be used in hot- and cold-rolling strings to move the working rolls or any of the backup rolls. It is particularly useful in arrangements such as described in European patent application Nos. 49,798 and 43,869 where changing the shape of the gap or nip between the working rolls. In particular two such devices according to this invention can be provided one directly above the other to position the rolls and lock them exactly in place, all without subjecting them to any nonaxial forces.

DESCRIPTION OF THE DRAWING

The above and other features and advantages will become more readily apparent from the following, reference being made to the accompanying drawing in which.

SPECIFIC DESCRIPTION

Figure 1:
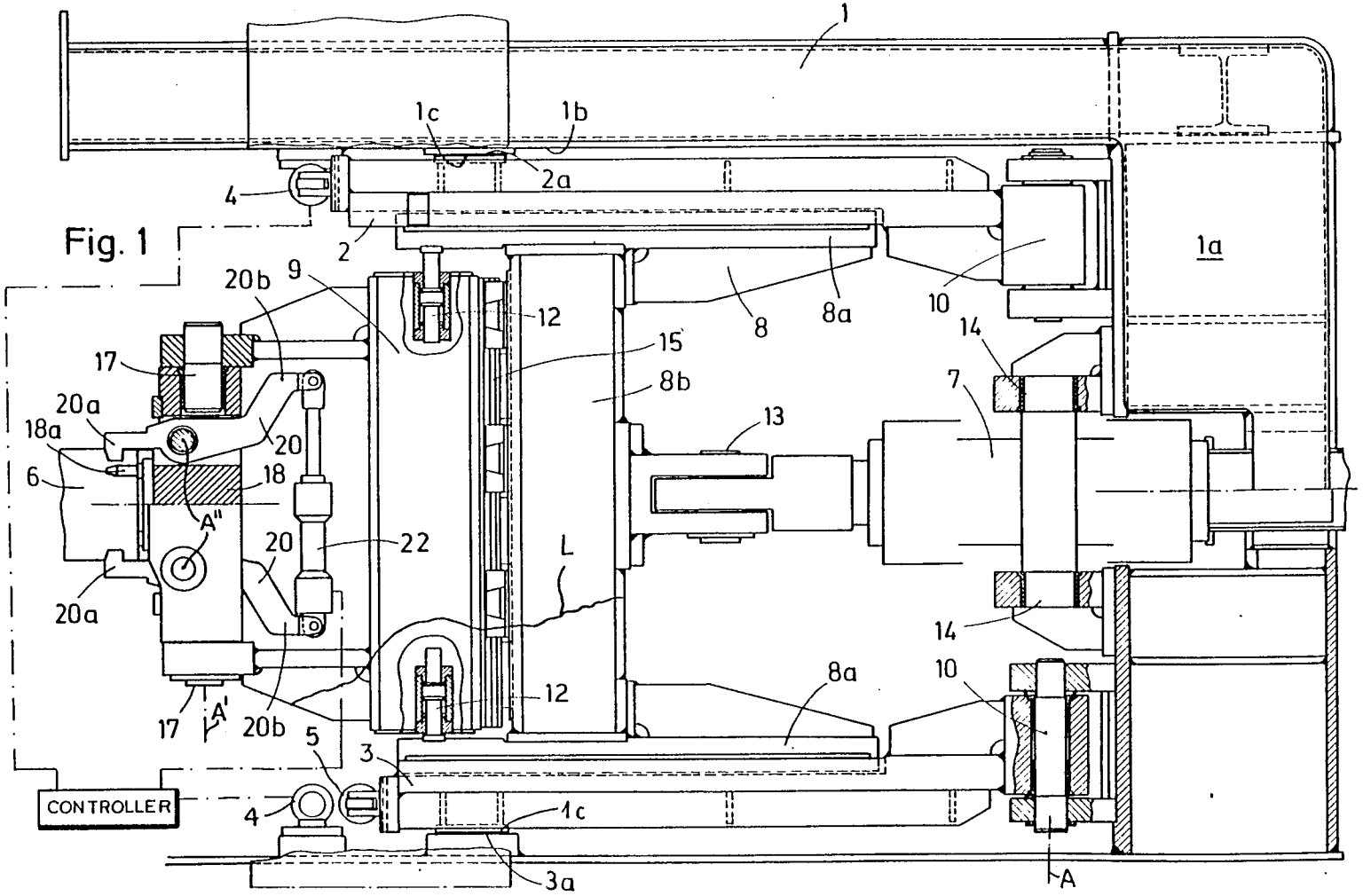
FIG. 1 is a partly sectional top view of the apparatus according to this invention.
Figure 2:
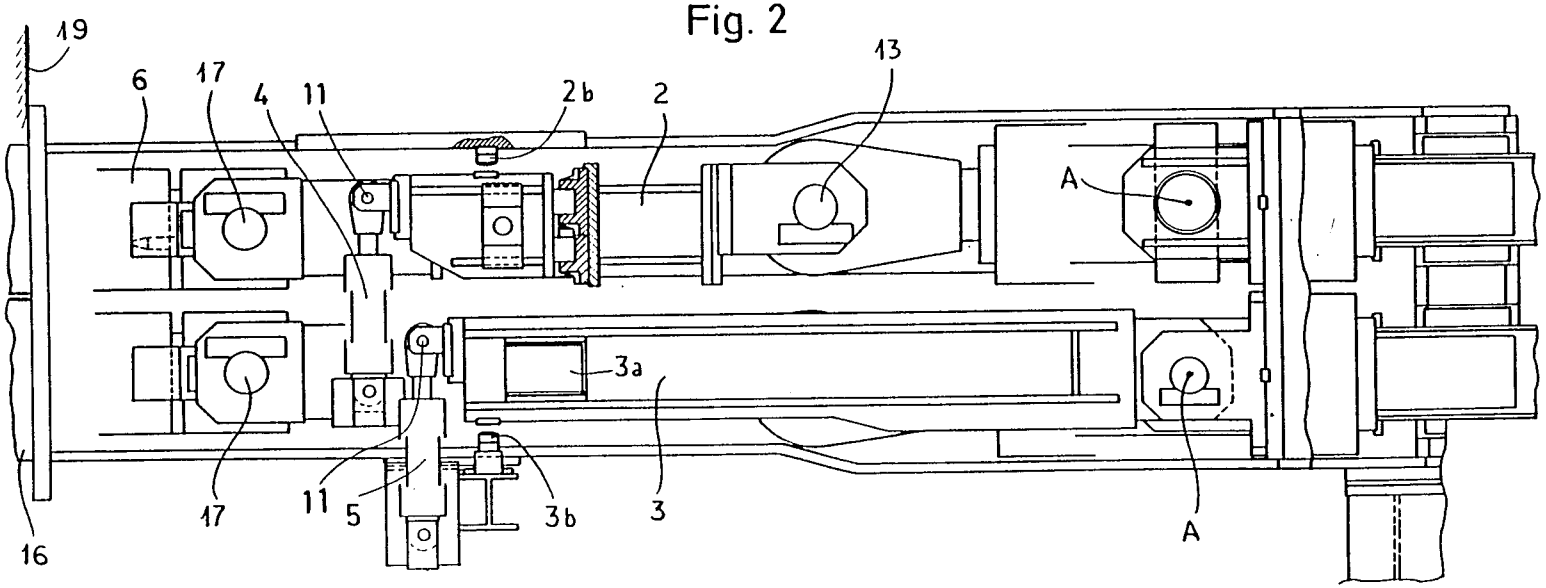
FIG. 2 is a partly sectional side view of the apparatus.

As seen in the drawing the system of this invention comprises two identical setups for pulling out two respective rolls 16 held in journal blocks 6 of a roll stand. Both devices are substantially identical and in FIG. 1 the rough line L is the border between the lower part of the drawing which illustrates the lower apparatus and the upper part which shows the upper one. In FIG. 2 the upper device is shown in section taken vertically through its center and the lower device is shown mainly in side view.

The apparatus basically comprises a massive U-shaped frame 1 open horizontally (to the left in FIGS. 1 and 2) toward a roll stand shown schematically at 19 and having rolls 6 and journal blocks 16. The U-frame 1 has a pair of massive arms 1*b* bridged by a center part or bight 1*a* carrying two coaxial and horizontally spaced upper pivots 10 centered on an axis A and supporting a pair of upper long arms 2, and two coaxially and horizontally spaced lower pivots 10 centered on another horizontal axis A and supporting a respective pair of lower short arms 3. The inner ends of the arms 2 and 3, which extend horizontally from the respective axes A toward the roll stand 19, have horizontal pivots 11 in which are secured the upper ends of respective hydraulic rams 4 and 5 that serve to vertically position these arms 2 and 3, pivoting them about their respective axes A.

The description below will relate mainly to the upper device having the long arms 2, but it is to be understood that the construction and operation of the lower device is identical unless differences are noted.

The arms 2 are always parallel, their cylinders 4 being operated synchronously and jointly, and form guides for identical side members 8*a* of an inner H-frame 8 having a central massive crosspiece 8*b* that extends horizontally and parallel to the axis A. This crosspiece 8*b* is provided with a linear ball bearing 15 on which rides a main support 9 that can be moved on the crosspiece 8*b* parallel to the axis A by small hydraulic rams 12 that are braced against the inside faces of the two inner arms 8*a*.

This support 9 in turn is provided with pivot pins 17 defining an axis A′ parallel to the respective axis A for another mount 18 in turn carrying a pair of arms 20 forming tongs and having front ends 20*a* formed as hooks and rear ends 20*b* interconnected by a double-acting ram 22 so that these arms 20 can be pivoted about parallel normally upright axes A″. The angular orientation of the grab mount 18 is normally set automatically by a small hydraulic actuator to maintain the axes A″ perfectly vertical, regardless of the level of the inner ends of the arms 2. The grab mount 18 is also provided with a transfer centering pin 18*a* that fits into the journal block 6 whose notches are engaged by the hooks 20*a* in a manner well known in the art. The interfit of the pin 18*a* and the block 6 can, with the coupling of the hooks 20*a* to the block 6, align the mount 18 with the roll axis.

The arms 1*b* of the main outside frame 1 are provided with surfaces 1*c* against which slide surfaces 2*a* and 3*a* of the arms 2 and 3 to keep them centered. Similarly upper and lower stops 2*b* and 3*b* (FIG. 2) are provided to respectively limit the upward and downward travel of the upper and lower devices having the arms 2 and 3.

When the grab formed by the mount 18 and the hooks 20*a* is aligned with the respective roll 6 and has engaged it, the actuator cylinder 7 which has its inner end pivoted at 14 on the arm axis A and its outer end pivoted at 13 on the crosspiece 8*b* of the inner frame is operated to shift the roll.

I claim:

1. In combination with a roll stand having a roll centered on an axis and provided at one end with a journal block, an apparatus for axially shifting the roll comprising:

an outer frame fixed relative to the stand at the journal block;

a pair of arms extending parallel to one another and having outer ends pivoted on the outer frame at a common arm axis generally perpendicular to the roll axis and inner arm ends adjacent the block;

means including actuators engaged between the inner arm ends and the outer frame for vertically displacing the inner arm ends with pivoting of the arms about the arm axis to a position with the inner arm ends generally level with the journal block;

an inner frame slidable perpendicular to the arm axis on the arms;

a grab mount pivotal on the inner frame about an inner axis parallel to the arm axis;

a grab carried on the mount and axially couplable with the journal block; and means including an actuator having an inner end pivoted at the arm axis on the outer frame and an outer end pivoted on the inner frame for sliding the frame along the arms and thereby axially displacing the roll coupled to the grab.

2. The apparatus defined in claim 1 wherein the inner frame has a carriage displaceable on the inner frame parallel to the inner axis and carrying the grab mount, the apparatus further comprising means including at least one actuator braced between the inner frame and the carriage for displacing the carriage on the inner frame parallel to the inner axis.

3. The apparatus defined in claim 2 wherein the inner frame has a pair of side members extending along and guided on the respective arms and a crosspiece extending between the members and parallel to the inner axis, the inner actuator end being pivoted on the crosspiece and the carriage being slidable on the crosspiece.

4. The apparatus defined in claim 1 wherein the arms have outer surfaces slidable on inner surfaces of the outer frame.

5. The apparatus defined in claim 1, further comprising an abutment fixed on the outer frame and limiting vertical displacement of the arms.

6. The apparatus defined in claim 1 wherein the grab is provided with a centering transfer pin engageable parallel to the roll axis in the journal block.

7. The apparatus defined in claim 1 wherein the roll stand has a plurality of rolls that are vertically spaced and all of the rolls have horizontal axes.

* * * * *